US011258177B2

(12) United States Patent
Duan et al.

(10) Patent No.: US 11,258,177 B2
(45) Date of Patent: Feb. 22, 2022

(54) ANTENNA UNIT, ARRAY ANTENNA, AND ELECTRONIC DEVICE

(71) Applicant: BEIJING XIAOMI MOBILE SOFTWARE CO., LTD., Beijing (CN)

(72) Inventors: Xiaochao Duan, Beijing (CN); Lupeng Zhang, Beijing (CN)

(73) Assignee: Beijing Xiaomi Mobile Software Co., Ltd., Beijing (CN)

( * ) Notice: Subject to any disclaimer, the term of this patent is extended or adjusted under 35 U.S.C. 154(b) by 118 days.

(21) Appl. No.: 16/798,189

(22) Filed: Feb. 21, 2020

(65) Prior Publication Data

US 2021/0126372 A1 Apr. 29, 2021

(30) Foreign Application Priority Data

Oct. 29, 2019 (CN) ..... 201911040141.5

(51) Int. Cl.
*H01Q 9/04* (2006.01)
*H01Q 1/24* (2006.01)
(Continued)

(52) U.S. Cl.
CPC ..... *H01Q 9/0457* (2013.01); *H01Q 1/24* (2013.01); *H01Q 1/36* (2013.01); *H01Q 9/04* (2013.01);
(Continued)

(58) Field of Classification Search
CPC ..... H01Q 9/0457; H01Q 1/36; H01Q 1/24; H01Q 21/0075; H01Q 9/04; H01Q 21/00;
(Continued)

(56) References Cited

U.S. PATENT DOCUMENTS 5,121,127 A * 6/1992 Toriyama ..... H01Q 9/0414 343/700 MS
6,850,191 B1 * 2/2005 Thill ..... H01Q 5/40 343/700 MS
(Continued)

FOREIGN PATENT DOCUMENTS

CN 110165384 A 8/2019
EP 1263083 A2 12/2002

OTHER PUBLICATIONS

Extended European Search Report in the European Application No. 20159664.0, dated Sep. 10, 2020, (14p).

*Primary Examiner* — Hai V Tran
(74) *Attorney, Agent, or Firm* — Arch & Lake LLP

(57) ABSTRACT

An antenna unit, an array antenna and an electronic device are provided. The antenna unit includes a first microstrip antenna, comprising a first radiating layer coupled to a first dielectric layer wherein the first microstrip antenna operates at a first band, a second microstrip antenna, comprising a second radiating layer, a second dielectric layer, and a ground layer, sequentially coupled, wherein the second radiating layer is coupled to a side of the first dielectric layer facing away from the first radiating layer, and wherein the second microstrip antenna operates at a second band that is smaller than the first band, a first feeder line, electrically coupled to the first radiating layer and the second radiating layer, and a second feeder line, electrically coupled to the second radiating layer and the ground layer.

19 Claims, 13 Drawing Sheets

(51) Int. Cl.
*H01Q 1/36* (2006.01)
*H01Q 21/00* (2006.01)

(52) U.S. Cl.
CPC ..... *H01Q 21/00* (2013.01); *H01Q 21/0075* (2013.01)

(58) Field of Classification Search
CPC ..... H01Q 5/307; H01Q 9/0414; H01Q 1/38; H01Q 9/045
USPC ..... 343/700 MS
See application file for complete search history.

(56) References Cited

U.S. PATENT DOCUMENTS

| | | | | |
|---|---|---|---|---|
| 7,277,056 | B1 * | 10/2007 | Thiam | H01Q 9/0414 343/700 MS |
| 7,295,167 | B2 * | 11/2007 | Aminzadeh | H01Q 1/3275 343/700 MS |
| 7,545,333 | B2 * | 6/2009 | Li | H01Q 1/1271 343/713 |
| 9,548,541 | B2 * | 1/2017 | Djerafi | H01Q 19/28 |
| 10,608,332 | B2 * | 3/2020 | Nishimoto | H01Q 1/528 |
| 2002/0186169 | A1 | 12/2002 | Iwai et al. | |
| 2003/0146872 | A1 | 8/2003 | Kellerman et al. | |
| 2005/0062651 | A1 * | 3/2005 | Dai | H01Q 9/0421 343/700 MS |
| 2006/0044189 | A1 | 3/2006 | Livingston et al. | |
| 2008/0136734 | A1 | 6/2008 | Manholm et al. | |
| 2019/0165472 | A1 | 5/2019 | Yun et al. | |

* cited by examiner

ANTENNA UNIT, ARRAY ANTENNA, AND ELECTRONIC DEVICE

CROSS-REFERENCE TO RELATED APPLICATION

This application is based upon and claims priority to Chinese Patent Application No. 201911040141.5, filed on Oct. 29, 2019, the entire contents of which are incorporated herein by reference.

TECHNICAL FIELD

The disclosure relates to the field of 5G communications, and more particularly, to an antenna unit, an array antenna, and an electronic device.

BACKGROUND

With the research of a 5G technology (5th generation mobile networks), antenna units of more and more electronic devices support 5G communication(s). However, due to user requirements such as portability and the like, the size of the electronic device is limited, which is not conducive to arranging a plurality of antenna units supporting different bands, and thus is not conducive to the electronic device supporting a plurality of bands for/in 5G communication.

SUMMARY

According to a first aspect of the disclosure, there is provided an antenna unit. The antenna unit includes: a first microstrip antenna, comprising a first radiating layer coupled to a first dielectric layer wherein the first microstrip antenna operates at a first band, a second microstrip antenna, comprising a second radiating layer, a second dielectric layer, and a ground layer, sequentially coupled, wherein the second radiating layer is coupled to a side of the first dielectric layer facing away from the first radiating layer, and wherein the second microstrip antenna operates at a second band that is smaller than the first band, a first feeder line, electrically coupled to the first radiating layer and the second radiating layer, and a second feeder line, electrically coupled to the second radiating layer and the ground layer.

According to a second aspect of the disclosure, there is provided an array antenna. The array antenna includes at least two antenna units, at least one of the two antenna units comprising: a first microstrip antenna, comprising a first radiating layer coupled to a first dielectric layer wherein the first microstrip antenna operates at a first band, a second microstrip antenna, comprising a second radiating layer, a second dielectric layer, and a ground layer, sequentially coupled, wherein the second radiating layer is coupled to a side of the first dielectric layer facing away from the first radiating layer, and wherein the second microstrip antenna operates at a second band that is smaller than the first band, a first feeder line, electrically coupled to the first radiating layer and the second radiating layer, and a second feeder line, electrically coupled to the second radiating layer and the ground layer, wherein a distance between centers of two adjacent antenna units is 0.5 to 0.7 times an operating wavelength of the antenna unit.

According to a third aspect of the disclosure, there is provided an electronic device. The electronic device includes at least one antenna unit or comprising an array antenna including at least two antenna units. The antenna units comprising: a first microstrip antenna, comprising a first radiating layer coupled to a first dielectric layer wherein the first microstrip antenna operates at a first band, a second microstrip antenna, comprising a second radiating layer, a second dielectric layer, and a ground layer, sequentially coupled, wherein the second radiating layer is coupled to a side of the first dielectric layer facing away from the first radiating layer, and wherein the second microstrip antenna operates at a second band that is smaller than the first band, a first feeder line, electrically coupled to the first radiating layer and the second radiating layer, and a second feeder line, electrically coupled to the second radiating layer and the ground layer, wherein a distance between centers of two adjacent antenna units of the array antenna is 0.5 to 0.7 times an operating wavelength of the antenna unit.

It is to be understood that both the foregoing general description and the following detailed description are examples and explanatory only and are not restrictive of the present disclosure, as claimed.

DETAILED DESCRIPTION

Figure 1:
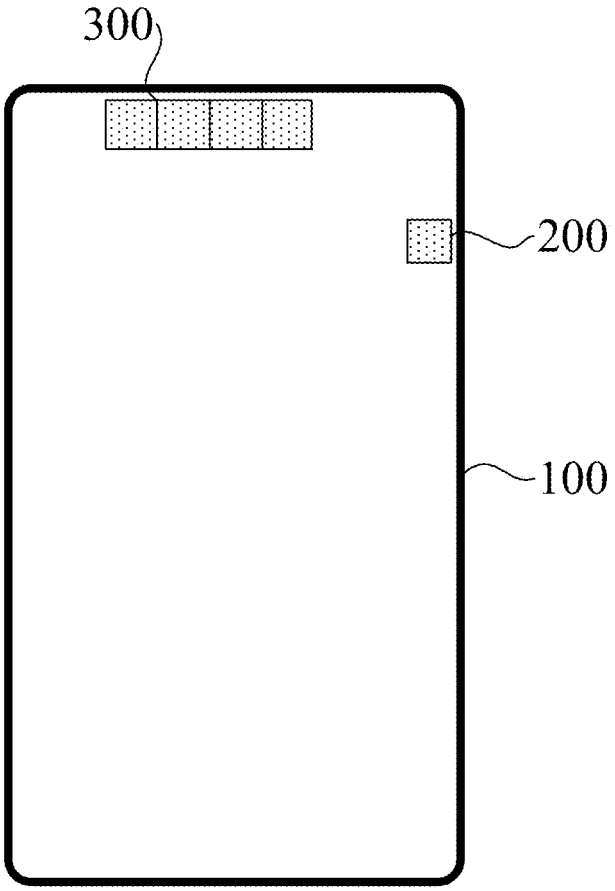
FIG. 1 is a partial structural diagram illustrating an electronic device, according to an example of the present disclosure.

Reference will now be made in detail to embodiments, examples of which are illustrated in the accompanying drawings. The following description refers to the accompanying drawings in which the same numbers in different drawings represent the same or similar elements unless otherwise represented. The implementations set forth in the following description of embodiments do not represent all implementations consistent with the disclosure. Instead, they are merely examples of apparatuses and methods consistent with aspects related to the disclosure as recited in the appended claims.

The terms used in the disclosure are for the purpose of describing particular embodiments only, and are not intended to limit the disclosure. Unless otherwise defined, technical terms or scientific terms used in the disclosure should be understood in the ordinary meaning of those of ordinary skill in the art to which the disclosure pertains. The words "first," "second," and similar terms used in the specification and claims of the disclosure are not intended to indicate any order, quantity or importance, but only to distinguish different components. Similarly, similar words "a" or "an" and the like do not denote a quantity limitation but mean that there is at least one. Unless otherwise specified, similar words "comprise" or "include" and the like mean that elements or objects preceding "comprise" or "include" encompass listed elements or objects following "comprise" or "include" and their equivalents, and do not exclude other elements or objects. Similar words "connect" or "connected" and the like are not limited to physical or mechanical connections, and can include electrical connections, whether direct or indirect.

"A/an," "the," and "this" in a singular form in the specification of the disclosure and the appended claims are also intended to include a plural form unless other meanings are clearly denoted throughout the disclosure. It is also to be understood that the term "and/or" used in the disclosure refers to and includes one or any or all possible combinations of multiple associated items that are listed.

In some embodiments, due to user requirements such as portability and the like, the integration degree of an electronic device is high, and the dimension and specification of the electronic device are limited, which is not conducive to arranging a plurality of antenna units that support different bands in the electronic device, and is not conducive to the electronic device supporting multi-band 5G communication. Moreover, the plurality of antenna units cannot be independently tuned, and it is difficult to tune. The resonance of different bands is badly robust to the size of the antenna units, which is not conducive to the electronic device supporting a multi-band 5G communication function.

An antenna unit can be one or more antennas arranged to transmit in at least one or more frequency bands. See FIGS. 2, 3, and 4 for an example structure of an antenna unit. For example, an antenna unit can have two antennas arranged to transmit in two frequency bands, one for each.

Embodiments of the disclosure provide an antenna unit, an array antenna, and an electronic device. The details are as follows.

FIG. 1 is a partial structural diagram illustrating an electronic device, according to an embodiment of the present disclosure. As illustrated in FIG. 1, the electronic device includes a body 100 and an antenna unit 200 or an array antenna 300 in the disclosure. The antenna unit 200 or the array antenna 300 is disposed in the body 100 to support a Wifi (a wireless local area network technology based on an IEEE 802.11 standard) function, a Global Positioning System (GPS) function, and other antenna communication functions of the electronic device.

The electronic device in the embodiments of the disclosure includes, but is not limited to, mobile phones, tablet computers, iPads, digital broadcasting terminals, messaging devices, game consoles, medical devices, fitness devices, personal digital assistants, smart wearable devices, smart TVs, etc.

Figure 2:
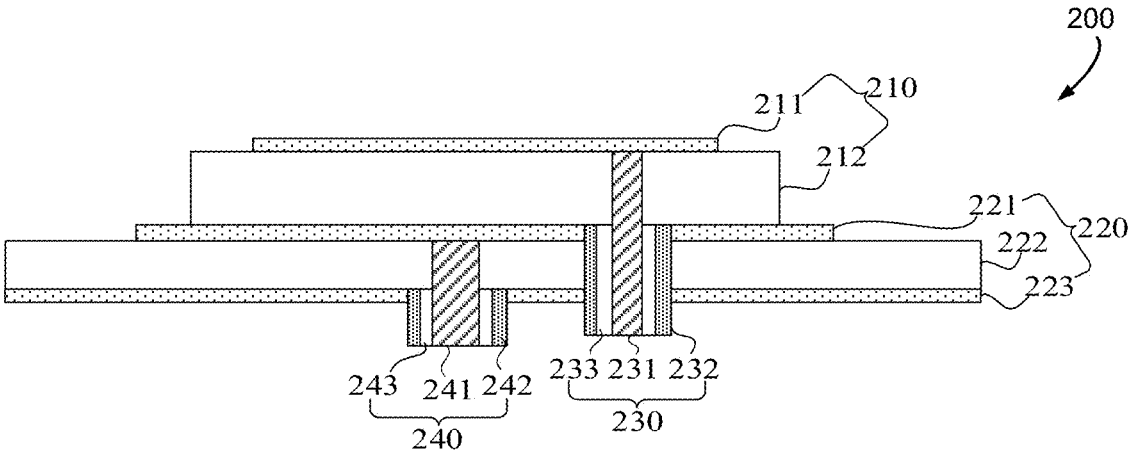
FIG. 2 is a partial cross-sectional view illustrating an antenna unit, according to an example of the present disclosure.
Figure 3:
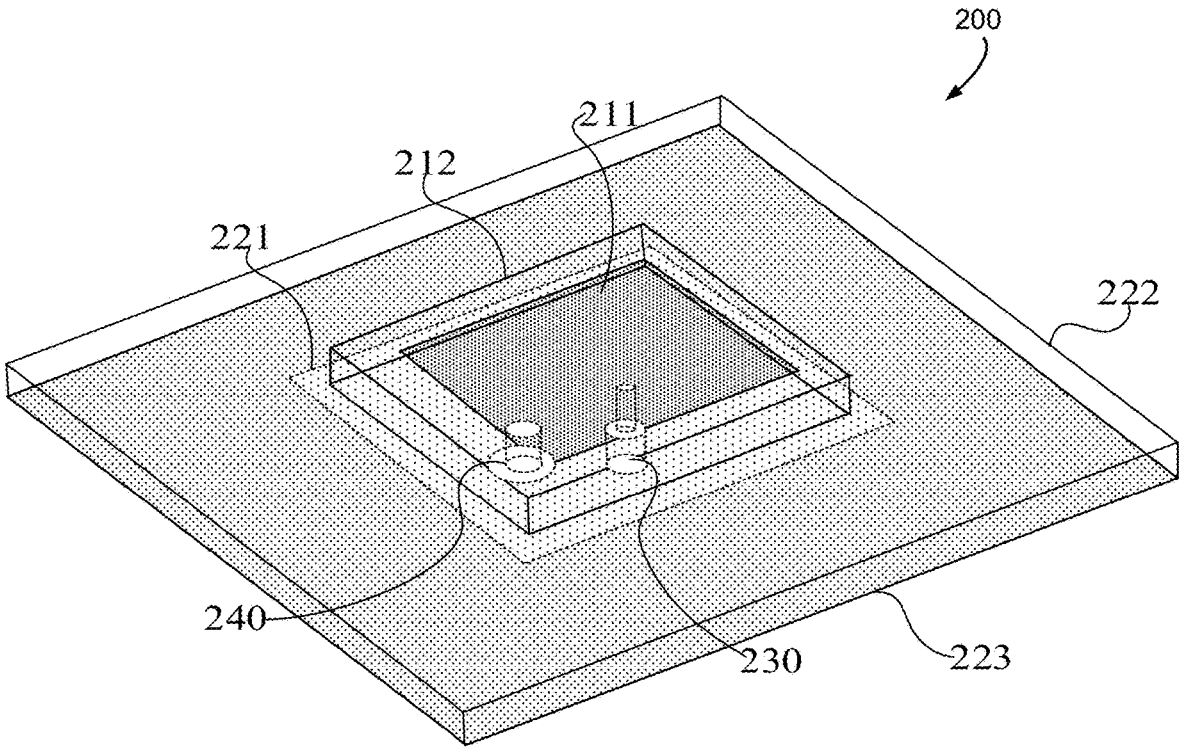
FIG. 3 is a diagram illustrating an antenna unit, according to an example of the present disclosure.

FIG. 2 is a partial cross-sectional view illustrating an antenna unit 200, according to an embodiment of the present disclosure. FIG. 3 is a diagram illustrating an antenna unit 200, according to an embodiment of the present disclosure.

With reference to FIG. 2 and FIG. 3, the antenna unit 200 includes a first microstrip antenna 210, a second microstrip antenna 220, a first feeder line 230, and a second feeder line 240. The first microstrip antenna 210 includes a first radiating layer 211 and a first dielectric layer 212, which are attached, and an operating band of the first microstrip antenna 210 includes a first band. The second microstrip antenna 220 includes a second radiating layer 221, a second dielectric layer 222, and a ground layer 223, which are sequentially attached. The second radiating layer 221 is also attached to a side of the first dielectric layer 212 facing away from the first radiating layer 211, and an operating band of the second microstrip antenna 220 includes a second band which is smaller/less than the first band.

In some embodiments of the disclosure, the first radiating layer 211, the second radiating layer 221, and the ground layer 223 are all conductive metal layers, such as a copper layer, an aluminum layer and the like. The first dielectric layer 212 and the second dielectric layer 222 are non-conductive insulating layers, such as a rubber layer, a plastic layer, and the like. The first dielectric layer 212 and the second dielectric layer 222 support and isolate the corresponding metal layers.

In some embodiments, the operating frequency of the first band includes a high-frequency band of 5G communication, such as 40.5 to 43.5 GHz. For example, it can be 40.5 GHz, 41 GHz, 41.5 GHz, 42 GHz, 42.5 GHz, 43 GHz, 43.5 GHz, etc. That is, the first microstrip antenna 210 supports frequencies in a band number n259. The operating frequency of the second band includes a low-frequency band of 5G communication, such as 26.5 to 29.5 GHz. For example, it can be 26.5 GHz, 26.8 GHz, 26.9 GHz, 27 GHz, 27.5 GHz, 27.7 GHz, 27.9 GHz, 28 GHz, 28.4 GHz, 28.9 GHz, 29 GHz, 29.5 GHz, etc. That is, the second microstrip antenna 220 supports frequencies in a band number n257.

The first feeder line 230 is electrically connected to/with the first radiating layer 211 and the second radiating layer 221. The second radiating layer 221 can be used as a ground layer of the first microstrip antenna 210. The first feeder line 230 is provided in various forms. For example, the first feeder line 230 is a coaxial feeder line that intersects the layer of the first microstrip antenna 210. In another example, the first feeder line 230 is a coaxial feeder line that penetrates into the layer of the first microstrip antenna 210. For example, the first feeder line 230 is a lead wire and can be electrically connected to the first radiating layer 211 and the second radiating layer 221 directly from the outside of the first microstrip antenna 210.

In some embodiments, the first feeder line 230 is a coaxial feeder line, and includes a first inner feeder line 231, a first insulated wire 233 and a first outer feeder line 232 coaxially arranged from inside to outside. The first feeder line 230 penetrates or intersects from the ground layer 223, and the first outer feeder line 232 and the first insulated wire 233 are cut off by the second radiating layer 221. The first outer feeder line 232 is electrically connected to the second radiating layer 221. The first inner feeder line 231 is cut off by the first dielectric layer 212, and the first inner feeder line 231 is electrically connected to the first radiating layer 211. It is to be noted that an axis of the first feeder line 230 can be perpendicular to the layers of the first microstrip antenna 210 and the second microstrip antenna 220. The first insulated wire 233 isolates the first inner feeder line 231 form the first outer feeder line 232. The first feeder line 230 of the above structure regularizes the structure of the antenna unit 200, which is advantageous for reducing the volume.

With continued reference to FIG. 2, the second feeder line 240 is electrically connected to the second radiating layer 221 and the ground layer 223. The second feeder line 240 is provided in various forms. For example, the second feeder line 240 is a coaxial feeder line that penetrates into the layer(s) of the second microstrip antenna 220. In another example, the second feeder line 240 is a coaxial feeder line that intersects the layer(s) of the second microstrip antenna 220. For example, the second feeder line 240 is a lead wire and can be electrically connected to the second radiating layer 221 and the ground layer 223 directly from the outside of the second microstrip antenna 220.

In some embodiments, the second feeder line 240 is a coaxial feeder line, and the second feeder line 240 includes a second inner feeder line 241, a second insulated wire 243 and a second outer feeder line 242 coaxially arranged from inside to outside. The second feeder line 240 penetrates or intersects from the ground layer 223, and the second outer feeder line 242 and the second insulated wire 243 are cut off by the ground layer 223. The second outer feeder line 242 is electrically connected to the ground layer 223. The second inner feeder line 241 is cut off by the second dielectric layer 222, and the second inner feeder line 241 is electrically connected to the second radiating layer 221. It is to be noted that an axis of the second feeder line 240 is perpendicular to the layers of the first microstrip antenna 210 and the second microstrip antenna 220. The second insulated wire 243 isolates the second inner feeder line 241 from the second outer feeder line 242. The second feeder line 240 of the above structure regularizes the structure of the antenna unit 200, which is advantageous for reducing the volume.

The antenna unit 200 in the embodiments of the disclosure is based on the structure of the first microstrip antenna 210 and the second microstrip antenna 220 which are attached to each other, so that the structure of the antenna unit 200 is compact and three-dimensional, which is conducive to reducing the occupied area of the antenna unit 200. The first microstrip antenna 210 is fed by the first feeder line 230, and the second microstrip antenna 220 is fed by the second feeder line 240 to achieve independent tuning. Based on the above, the antenna unit 200 has good robustness to dimensional errors, has a good gain, achieves dual-frequency independent tuning in 5G communication, and can be used in highly integrated electronic devices.

As the gain of the antenna unit 200 is higher, the distance of radio wave transmission is longer, and the 5G communication performance is better. In order to make the antenna unit 200 have a good gain, in some embodiments, with continued reference to FIG. 2, a projection area of the first radiating layer 211 on the first dielectric layer 212, a projection area of the second radiating layer 221 on the second dielectric layer 222 and a projection area of the ground layer 223 on the second dielectric layer 222 are reduced sequentially. For example, [DF1] the length and width of the first radiating layer are smaller than the length and width of the first dielectric area, which are smaller than the length and width of the second radiating layer. In another example, the length and width of the first radiating layer are smaller than the length and width of the first dielectric area, which are smaller than the length and width of the second radiating layer, which are smaller than the length and width of the ground layer. In some embodiments, in this way, it is beneficial for the first microstrip antenna 210 to support a first band of 5G communication and for the second microstrip antenna 220 to support a second band of 5G communication. Moreover, the increase of the ground area of the first microstrip antenna 210 and the increase of the ground area of the second microstrip antenna 220 are beneficial for the first microstrip antenna 210 and the second microstrip antenna 220 to have a good gain.

Furthermore, with continued reference to FIG. 2, the first feeder line 230 can also be electrically connected to the ground layer 223. In the case that the first feeder line 230 is a coaxial feeder line, the first outer feeder line 232 is electrically connected to the ground layer 223. In this way, the ground area of the first microstrip antenna 210 is further increased, thereby improving the gain of the first microstrip antenna 210.

In some embodiments, a projection area of the first radiating layer 211 on the second radiating layer 221 is centered with the middle of the second radiating layer 221. For example, the center of the projection area of the first radiating layer is aligned with the center of the second radiating layer. In some embodiments, in this way, in a three-dimensional space, the radiation patterns of the first microstrip antenna 210 and the second microstrip antenna 220 are more regular, so as to avoid a large offset therebetween. Thus, the radiation direction of the antenna unit 200 is regular, which is conducive to adjusting an arrangement position of the antenna unit 200 in the electronic device.

The structures of the first radiating layer 211, the second radiating layer 221, and the ground layer 223 have an important influence on the performance of the antenna unit 200. The disclosure provides the following examples for the structures of the first radiating layer 211, the second radiating layer 221, and the ground layer 223.

At least one of the projection areas of the first radiating layer 211 on the first dielectric layer 212, the projection area of the second radiating layer 221 on the second dielectric layer 222 or the projection area of the ground layer 223 on the second dielectric layer 222 is circular, square, elliptical ring-shaped, fan-shaped, semicircular, triangular or irregular. In some embodiments, each film layer adopting/of the above structure is beneficial for the antenna unit 200 to have a good gain, and the structures are simple and easy to set.

The dimensions and specifications of the first radiating layer 211, the second radiating layer 221, the ground layer 223, the first dielectric layer 212, and the second dielectric layer 222 have an important influence on the performance of the antenna unit 200. The disclosure provides the following examples for the structure of the antenna unit 200.

The projection area of the first radiating layer 211 on the first dielectric layer 212 is a square with a side length of 1.5 to 2 mm. For example, it can be 1.5 mm, 1.6 mm, 1.7 mm, 1.72 mm, 1.8 mm, 1.9 mm, 2 mm, etc. And/or, the projection area of the first dielectric layer 212 on the second radiating layer 221 is a square with a side length of 2.1 to 2.5 mm. For example, it can be 2.1 mm, 2.2 mm, 2.3 mm, 2.4 mm, 2.5 mm, etc. And/or, the projection area of the second radiating layer 221 on the second dielectric layer 222 is a square with a side length of 2.5 to 2.8 mm. For example, it can be 2.5 mm, 2.6 mm, 2.64 mm, 2.7 mm, 2.8 mm, etc. And/or, the projection area of the ground layer 223 on the second dielectric layer 222 is a square with a side length of 4 to 5 mm. For example, it can be 4 mm, 4.1 mm, 4.2 mm, 4.3 mm, 4.4 mm, 4.5 mm, 4.6 mm, 4.7 mm, 4.8 mm, 4.9 mm, 5 mm, etc. And/or, the first dielectric layer 212 has a thickness of 0.3 to 0.4 mm. For example, it can be 0.3 mm, 0.31 mm, 0.32 mm, 0.33 mm, 0.335 mm, 0.34 mm, 0.35 mm, 0.36 mm, 0.37 mm, 0.38 mm, 0.39 mm, 0.4 mm, etc. And/or, the second dielectric layer 222 has a thickness of 0.2 to 0.3 mm. For example, it can be 0.2 mm, 0.21 mm, 0.22 mm, 0.23 mm, 0.24 mm, 0.25 mm, 0.254 mm, 0.26 mm, 0.27 mm, 0.28 mm, 0.29 mm, 0.3 mm, etc. In some embodiments, by using such an arrangement, the antenna unit 200 has a small volume, a small thickness, a low profile, and good robustness to dimensional errors, and is beneficial to be applied to highly integrated electronic devices. In addition, the antenna unit 200 can achieve 5G dual-frequency bands which are independently tuned and has a good gain.

Figure 4:
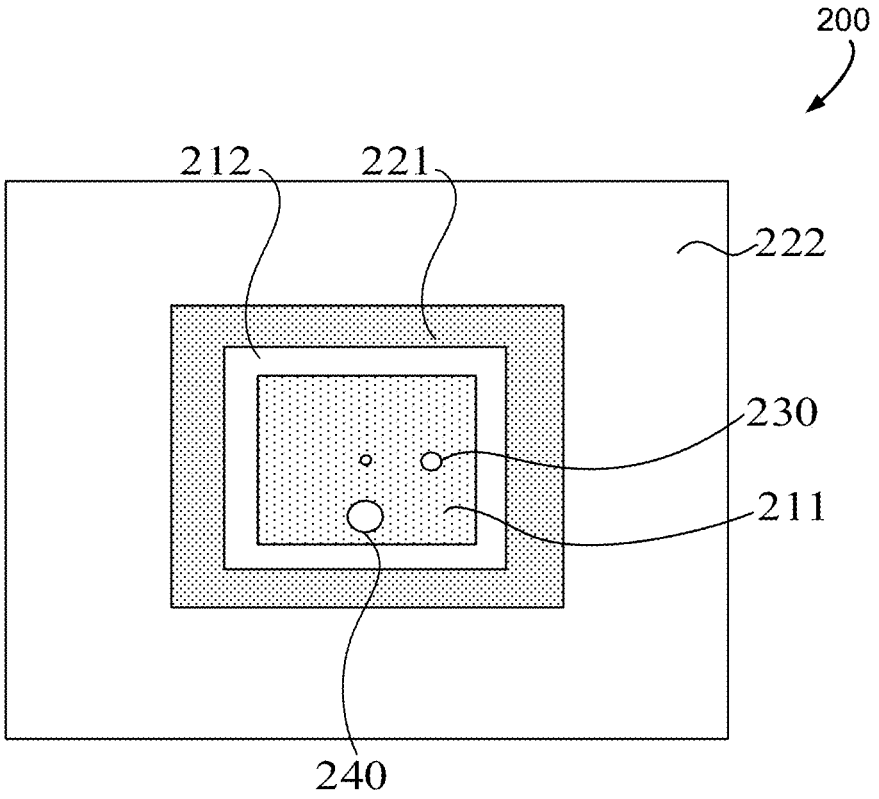
FIG. 4 is a top view illustrating an antenna unit, according to an example of the present disclosure.

FIG. 4 is a top view illustrating an antenna unit 200, according to an embodiment of the present disclosure. As illustrated in FIG. 4, the projection area of the first radiating layer 211 on the first dielectric layer 212, the projection area of the second radiating layer 221 on the second dielectric layer 222, and the projection area of the ground layer 223 (not shown in FIG. 4, refer to FIG. 2) on the second dielectric layer 222 are all squares, and centers of those overlap. The first feeder line 230 penetrates or intersects the first microstrip antenna 210 vertically, and a distance between an axis of the first feeder line 230 and the center(s) is 0.3 to 0.4 mm. For example, it can be 0.3 mm, 0.31 mm, 0.32 mm, 0.33 mm, 0.34 mm, 0.35 mm, 0.36 mm, 0.37 mm, 0.38 mm, 0.39 mm, 0.4 mm, etc. And/or, the second feeder line 240 penetrates or intersects the second microstrip antenna 220 vertically, and a distance between an axis of the second feeder line 240 and the center(s) is 0.45 to 0.55 mm. For example, it can be 0.45 mm, 0.46 mm, 0.47 mm, 0.48 mm, 0.49 mm, 0.5 mm, 0.51 mm, 0.52 mm, 0.53 mm, 0.54 mm, 0.55 mm, etc. In some embodiments, the positions of the first feeder line 230 and the second feeder line 240 are set so that the antenna impedances of the corresponding first microstrip antenna 210 and the second microstrip antenna 220 are close to 50 ohms, thereby making the first microstrip antenna 210 better match with the first feeder line 230 and the second microstrip antenna 220 better match with the second feeder line 240. Moreover, the energy emitted from the first feeder line 230 can be more radiated out by the first microstrip antenna 210, and energy emitted from the second feeder line 240 can be more radiated out by the second microstrip antenna 220, which is conducive to improving a standing 'wave ratio.

In particular, the projection area of the first radiating layer 211 on the first dielectric layer 212 is a square with a side length of 1.72 mm. The projection area of the first dielectric layer 212 on the second radiating layer 221 is a square with a side length of 2.2 mm. The projection area of the second radiating layer 221 on the second dielectric layer 222 is a square with a side length of 2.64 mm. The projection area of the ground layer 223 on the second dielectric layer 222 is a square with a side length of 5 mm. The first dielectric layer 212 has a thickness of 0.335 mm, and the second dielectric layer 222 has a thickness of 0.254 mm. The projection area of the first radiating layer 211 on the first dielectric layer 212, the projection area of the second radiating layer 221 on the second dielectric layer 222, and the projection area of the ground layer 223 on the second dielectric layer 222 are all squares, and centers of those overlap. The first feeder line 230 penetrates or intersects the first microstrip antenna 210 vertically, and the distance between the axis of the first feeder line 230 and the center is 0.36 mm. The second feeder line 240 penetrates or intersects the second microstrip antenna 220 vertically, and the distance between the axis of the second feeder line 240 and the center is 0.5 mm. By such an arrangement, the antenna unit 200 has a small volume, a small thickness, a low profile, and good robustness to dimensional errors, and is beneficial to be applied to highly integrated electronic devices. In addition, the antenna unit 200 can achieve 5G dual-frequency bands that are independently tuned and has a good gain and a better standing wave ratio.

The performance of the antenna unit 200 will be further described below in conjunction with a performance detection chart of the antenna unit 200.

Figure 5:
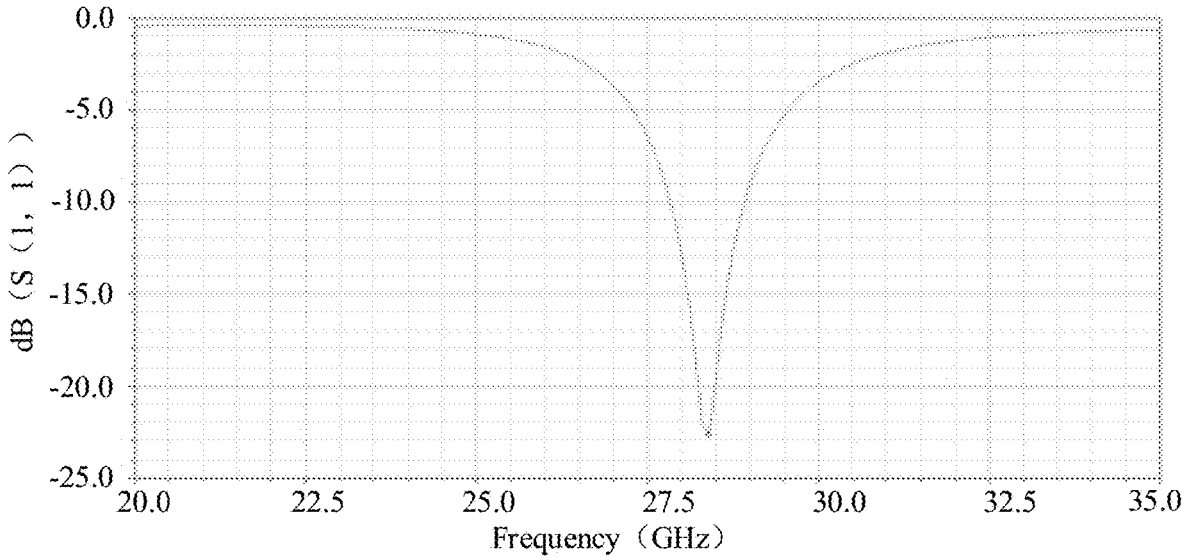
FIG. 5 is a return loss view illustrating an antenna unit at 28.4 GHz, according to an example of the present disclosure.
Figure 6:
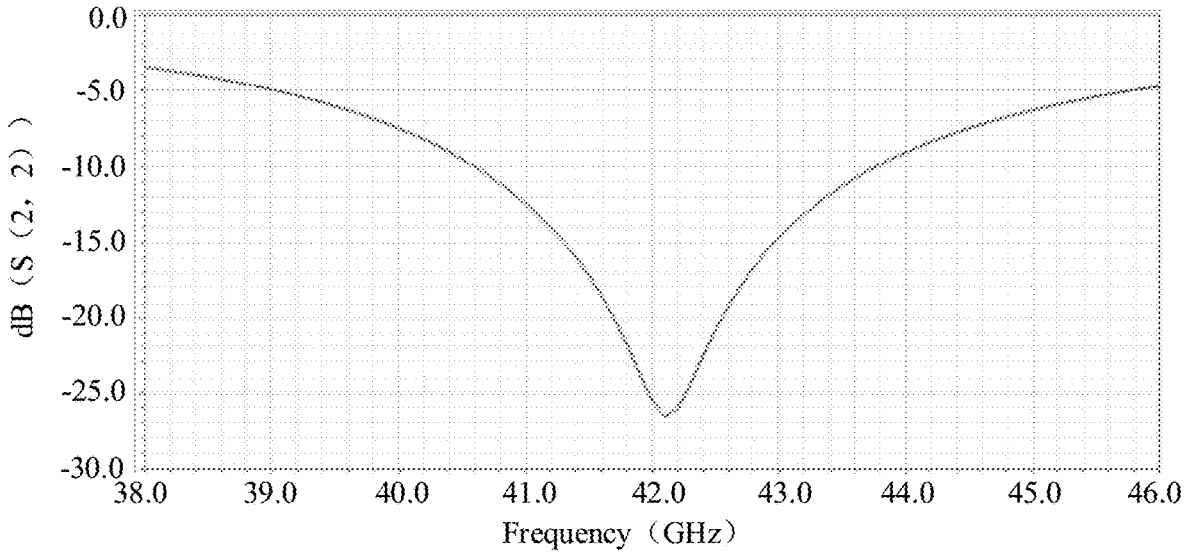
FIG. 6 is a return loss view illustrating an antenna unit at 42 GHz, according to an example of the present disclosure.

FIG. 5 is a return loss view illustrating an antenna unit 200 at 28.4 GHz, according to an embodiment of the present disclosure. As illustrated in FIG. 5, a return loss of the antenna unit 200 in a range of about 27.8 to 29 GHz is less than −10 dB, which enables the antenna unit 200 to operate stably in the range of 27.8 to 29 GHz and minimize the return loss at 28.4 GHz. The antenna unit 200 has a radiation performance at 28.4 GHz. FIG. 6 is a return loss view illustrating an antenna unit 200 at 42 GHz, according to an embodiment of the present disclosure. As illustrated in FIG. 6, a return loss of the antenna unit 200 in a range of about 40.6 to 43.8 GHz is less than −10 dB, which enables the antenna unit 200 to operate stably in the range of 40.6 to 43.8 GHz and minimize the return loss at 42.1 GHz. The antenna unit 200 has a radiation performance at 42.1 GHz. With reference to FIG. 5 and FIG. 6, it can be known that the antenna unit 200 in the disclosure can operate/work in a band range of 27.8 to 29 GHz (band number n257) and of 40.6 to 43.8 GHz (band number n259).

Figure 7:
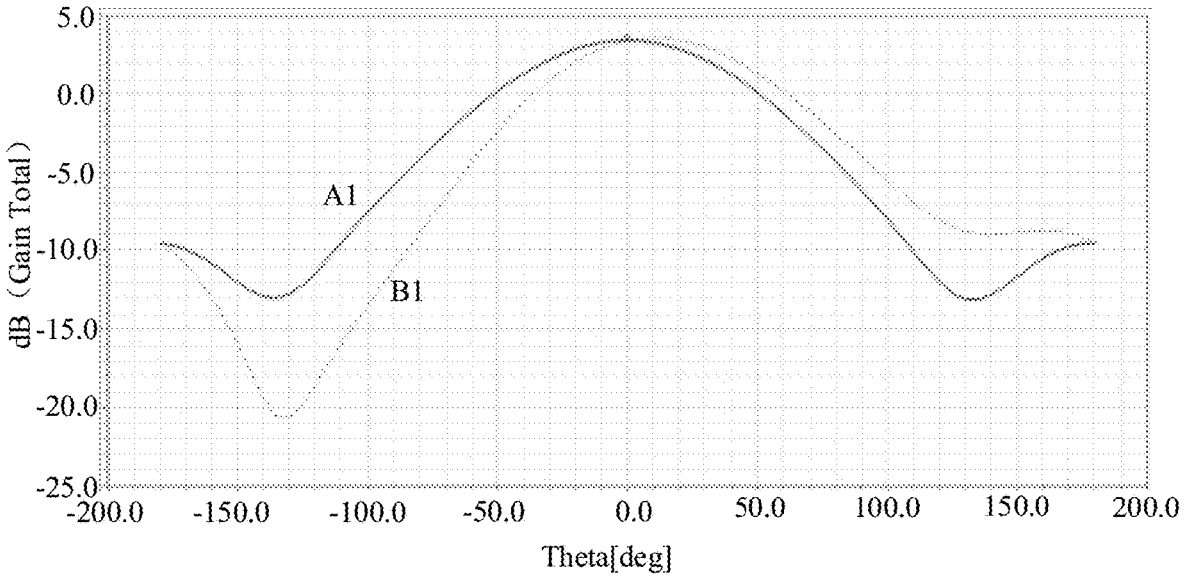
FIG. 7 is a gain view illustrating an antenna unit at 28.4 GHz, according to an example of the present disclosure.
Figure 8:
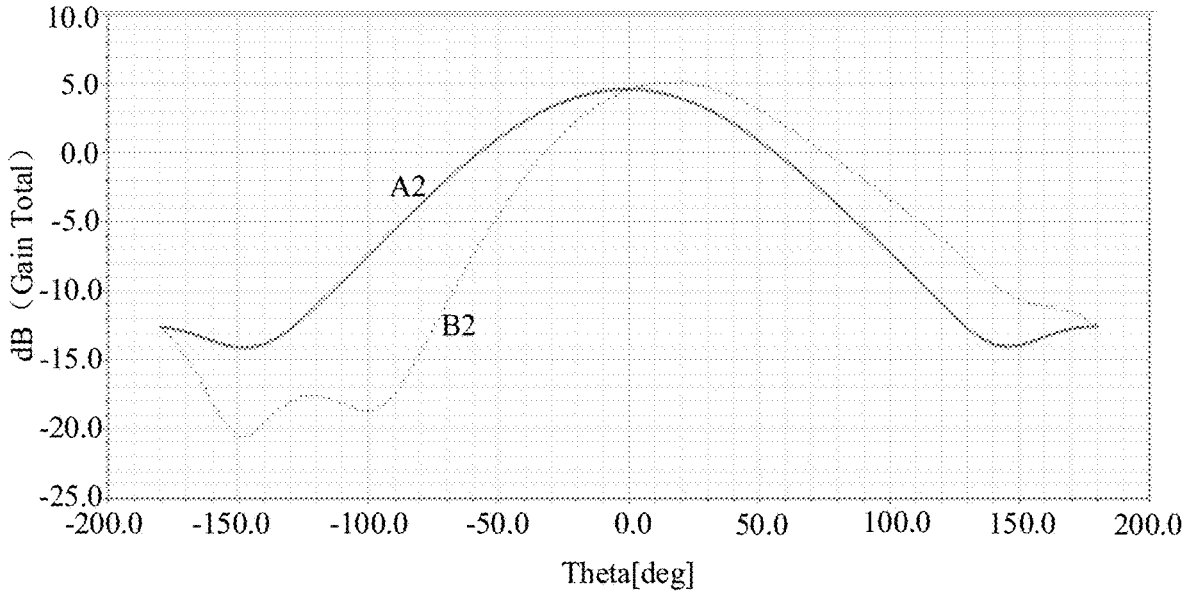
FIG. 8 is a gain view illustrating an antenna unit at 42 GHz, according to an example of the present disclosure.

FIG. 7 is a gain view illustrating an antenna unit 200 at 28.4 GHz, according to an embodiment of the present disclosure. A curve A1 is a gain curve measured at a frequency of 28.4 GHz and Phi=0 degrees (deg), and a curve B1 is a gain curve measured at a frequency of 28.4 GHz and Phi=90 deg. As illustrated in FIG. 7, the gains of the curve A1 and the curve B1 are greatest when Theta=0.0 deg, the gain of the curve A1 is greater than 0 when Theta range is between −50.0 deg and 50.0 deg, and the gain of the curve B1 is greater than 0 when Theta range is between −60.0 deg and 60.0 deg. FIG. 8 is a gain view illustrating an antenna unit 200 at 42 GHz, according to an embodiment of the present disclosure. A curve A2 is a gain curve measured at a frequency of 42 GHz and Phi=0 deg, and a curve B2 is a gain curve measured at a frequency of 42 GHz and Phi=90 deg. As illustrated in FIG. 8, the gain of the curve A2 is greatest when Theta=0.0 deg, and the gain of the curve A2 is greater than 0 when Theta range is between −60 deg and 55 deg. The gain of the curve B2 is greatest when Theta=20 deg, and the gain of the curve B2 is greater than 0 when Theta range is between −30 deg and 75 deg. With reference to FIG. 7 and FIG. 8, it can be known that the antenna unit 200 in the disclosure has a higher gain in the bands n257 and n259.

Figure 9:
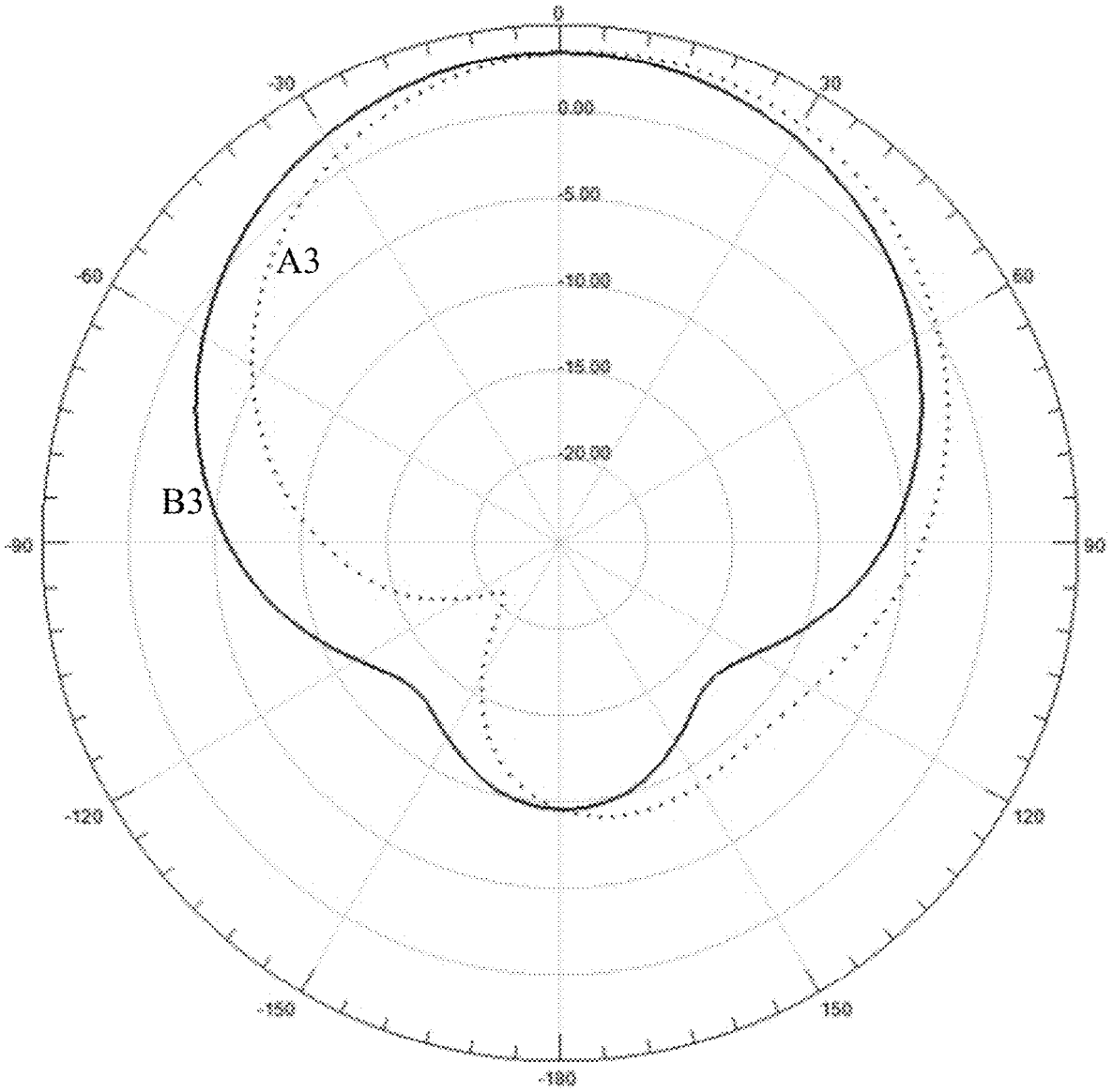
FIG. 9 is a two-dimensional radiation pattern illustrating an antenna unit at 28.4 GHz, according to an example of the present disclosure.
Figure 10:
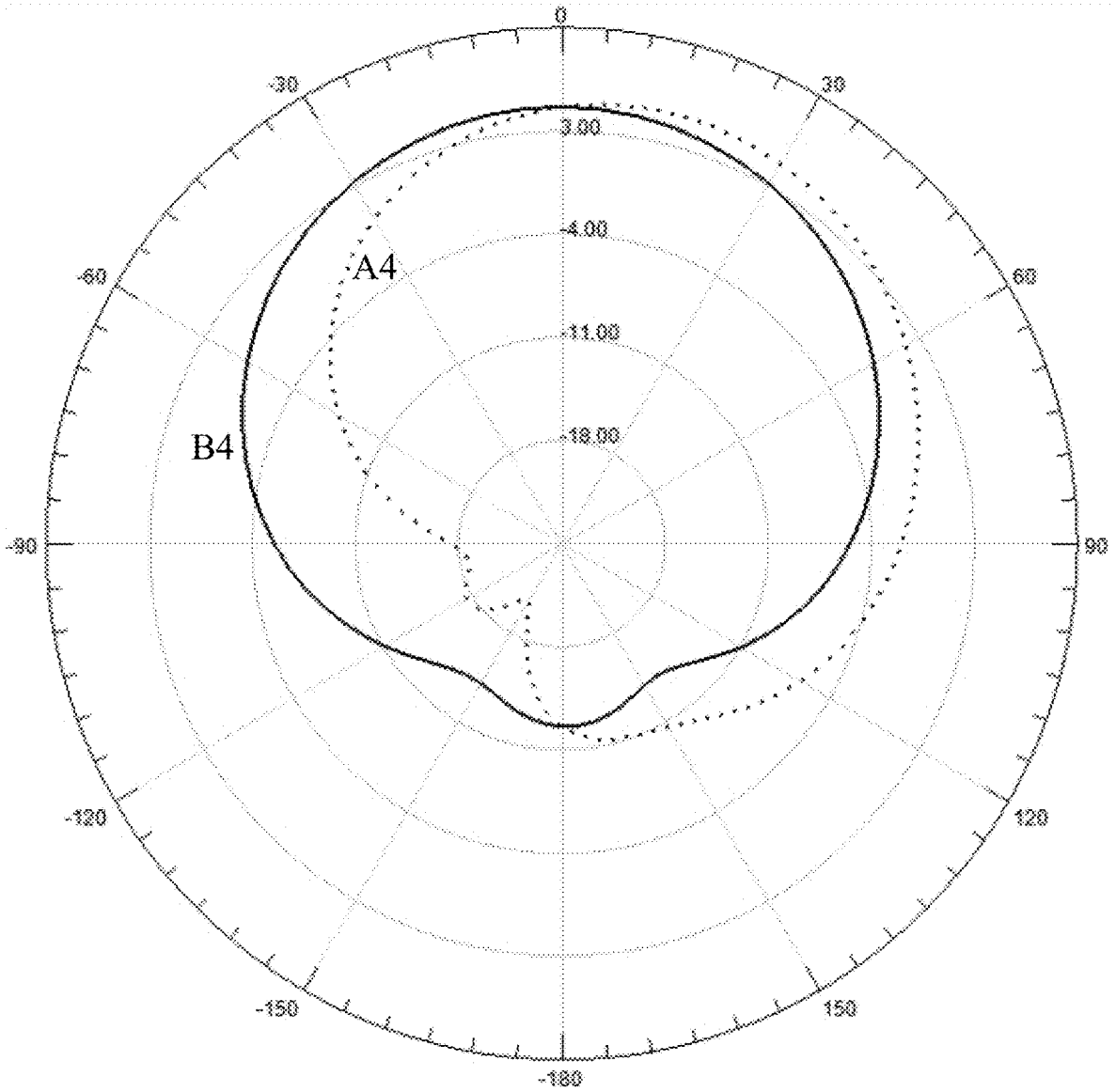
FIG. 10 is a two-dimensional radiation pattern illustrating an antenna unit at 42 GHz, according to an example of the present disclosure.

FIG. 9 is a two-dimensional radiation pattern illustrating an antenna unit 200 at 28.4 GHz, according to an embodiment of the present disclosure. A curve A3 is a two-dimensional radiation pattern measured at a frequency of 28.4 GHz and Phi=0 deg, and a curve B3 is a two-dimensional radiation pattern measured at a frequency of 28.4 GHz and Phi=90 deg. As illustrated in FIG. 9, regions occupied by the curve A3 and the curve B3 are relatively wide, which indicates that the radiation direction of the antenna unit 200 at 28.4 GHz is relatively wide, and the radiation range is large. FIG. 10 is a two-dimensional radiation pattern illustrating an antenna unit 200 at 42 GHz, according to an embodiment of the present disclosure. A curve A4 is a two-dimensional radiation pattern measured at a frequency of 42 GHz and Phi=0 deg, and a curve B4 is a two-dimensional radiation pattern measured at a frequency of 42 GHz and Phi=90 deg. As illustrated in FIG. 10, regions occupied by the curve A4 and the curve B4 are relatively wide, which indicates that the radiation direction of the antenna unit 200 at 42 GHz is relatively wide, and the radiation range is large. With reference to FIG. 9 and FIG.

10, it can be known that the radiation direction of the antenna unit 200 at 28.4 GHz and 42 GHz is relatively wide and the radiation range is relatively large, which makes the radiation angle range of a 5G signal relatively large and is conducive to the application of the antenna unit 200 in 5G communication.

Figure 11:
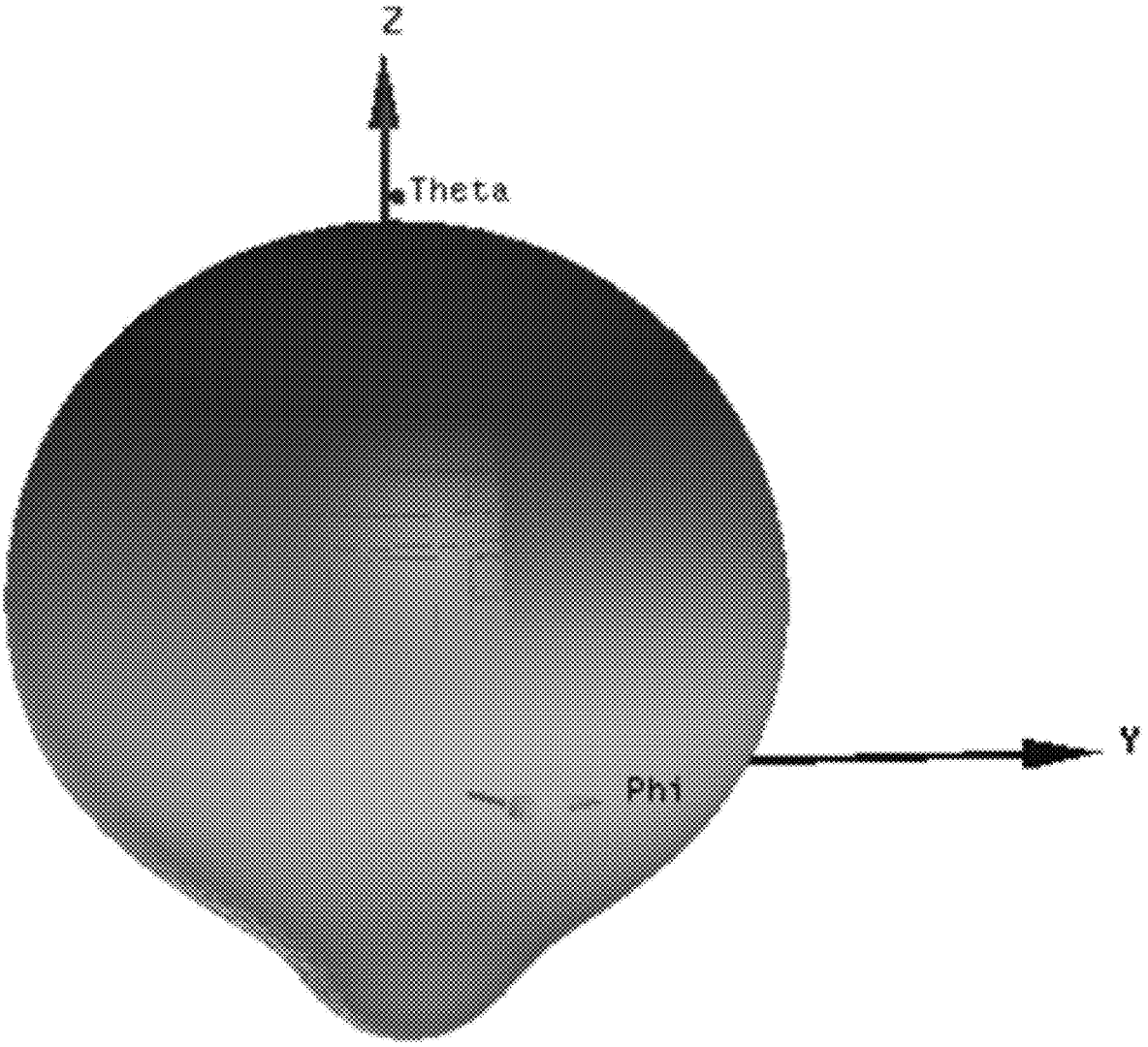
FIG. 11 is a three-dimensional radiation pattern illustrating an antenna unit at 28.4 GHz, according to an example of the present disclosure.
Figure 12:
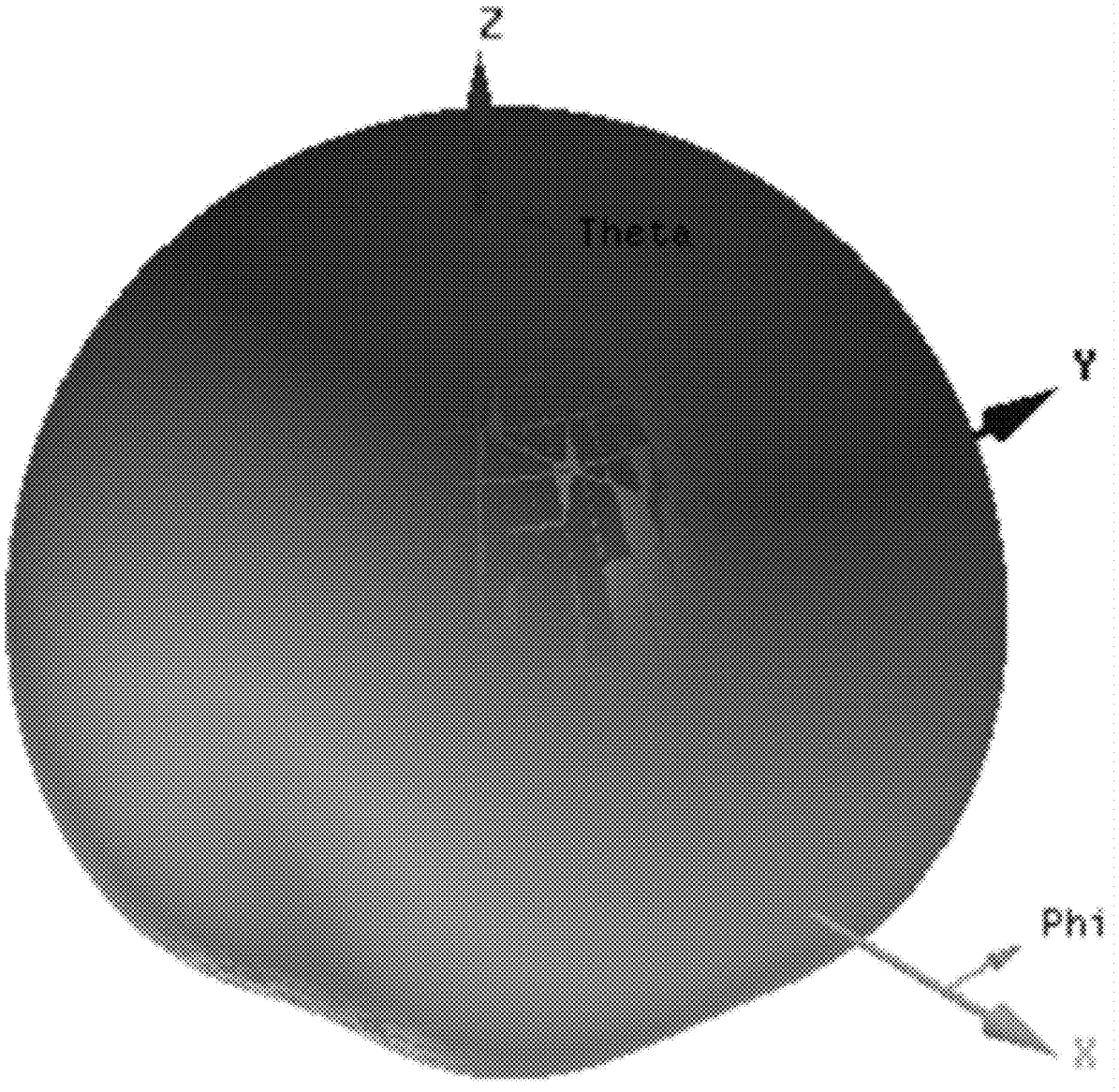
FIG. 12 is a three-dimensional radiation pattern illustrating an antenna unit at 42 GHz, according to an example of the present disclosure.

FIG. 11 is a three-dimensional radiation pattern illustrating an antenna unit 200 at 28.4 GHz, according to an embodiment of the present disclosure, in which a darker color represents higher radiation energy. In FIG. 11, the radiant energy of an upper hemisphere is higher than that of a lower hemisphere. FIG. 12 is a three-dimensional radiation pattern illustrating an antenna unit 200 at 42 GHz, according to an embodiment of the present disclosure. In FIG. 12, the radiant energy of an upper hemisphere is higher than that of a lower hemisphere. With reference to FIG. 11 and FIG. 12, it can be known that the antenna unit 200 has high radiant energy in a z-axis direction and has better radiation performance.

It is to be noted that a plane where the ground layer 223 of the second microstrip antenna 220 is located in an XY plane, and an axis that is perpendicular to the XY plane and passes through the center of the second microstrip antenna 220 is the Z-axis. Based on this orientation, FIGS. 7 to 12 are analyzed.

In summary, the antenna unit 200 in the embodiments of the disclosure can reduce the floor area, has the characteristics of small volume, small thickness, low profile, good robustness to dimensional errors, etc., and is beneficial to be applied to highly integrated electronic devices. The antenna unit 200 can independently tune 5G bands in two-band numbers n257 and n259 and has a good gain.

Figure 13:
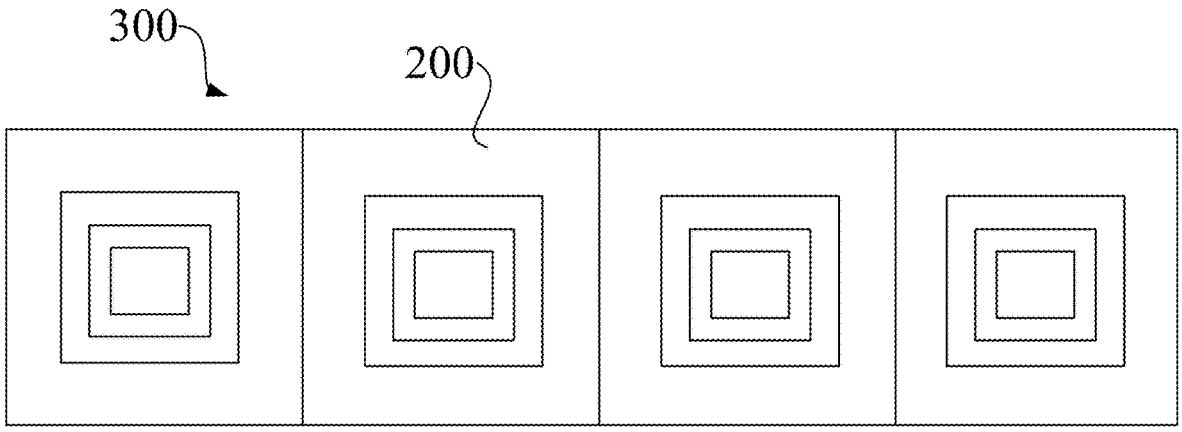
FIG. 13 is a structural diagram illustrating an array antenna, according to an example of the present disclosure.

FIG. 13 is a structural diagram illustrating an array antenna, according to an embodiment of the present disclosure. As illustrated in FIG. 13, the array antenna 300 includes at least two antenna units 200 of any of the types mentioned above, and a distance between two adjacent antenna units 200 is 0.5 to 0.7 times the operating wavelength of the antenna unit 200. In some embodiments, dual-frequency independent tuning is achieved in 5G communication, and the radiant energy of the antenna units 200 is concentrated, so that the array antenna 300 has a higher gain.

In some embodiments, with continued reference to FIG. 13, the array antenna 300 includes four antenna units 200 arranged side by side.

The electronic device in an embodiment of the disclosure is based on a compact and three-dimensional structure of the antenna unit 200 and the array antenna 300, which is conducive to achieving high integration and volume miniaturization of the electronic device. Moreover, the electronic device can easily achieve dual-frequency independent tuning in 5G communication, has a good 5G radiation performance, and is conducive to improving user experience.

Since the embodiments of the array antenna and the electronic device basically correspond to the embodiments of the antenna unit, the relevant part can refer to the partial description of the embodiments of the antenna unit. The embodiments of the array antenna and the electronic device are complementary to the embodiments of the antenna unit.

The above embodiments of the disclosure can complement each other without causing conflicts.

The above descriptions are only examples of the present disclosure and are not intended to limit the disclosure. Any modifications, equivalent replacements, improvements, and the like made within the spirit and principle of the disclosure should fall within the scope of protection of the disclosure.

What is claimed is:

1. An antenna unit, comprising:

a first microstrip antenna, comprising a first radiating layer coupled to a first dielectric layer wherein the first microstrip antenna operates at a first band;

a second microstrip antenna, comprising a second radiating layer, a second dielectric layer, and a ground layer, sequentially coupled, wherein the second radiating layer is coupled to a side of the first dielectric layer facing away from the first radiating layer, and wherein the second microstrip antenna operates at a second band at frequencies lower than those of the first band;

a first feeder line, electrically coupled to the first radiating layer and the second radiating layer; and a second feeder line, electrically coupled to the second radiating layer and the ground layer;

wherein the first radiating layer is a first projection area on the first dielectric layer, the second radiating layer is a second projection area on the second dielectric layer, and the ground layer is a third projection area on the second dielectric layer, wherein the first, second, and third projection areas are squared and the center of the projection areas overlap;

wherein the first feeder line intersects the first microstrip antenna and a distance between an axis of the first feeder line and the center of the projection areas is 0.3 to 0.4 mm; wherein the second feeder line intersects the second microstrip antenna, and a distance between an axis of the second feeder line and the center of the projection areas is 0.45 to 0.55 mm.

2. The antenna unit of claim 1, wherein the first radiating layer is a first projection area on the first dielectric layer, wherein the second radiating layer is a second projection area on the second dielectric layer, wherein the ground layer is a third projection area on the second dielectric layer, wherein at least two of the projection areas are reduced sequentially.

3. The antenna unit of claim 2, wherein the first feeder line is also electrically coupled to the ground layer.

4. The antenna unit of claim 2, wherein a center of the first projection area is aligned with a center of the second projection area.

5. The antenna unit of claim 1, wherein the first radiating layer is a projection area on the first dielectric layer and the projection is a square with a side length of 1.5 to 2 mm.

6. The antenna unit of claim 1, wherein the first dielectric layer is a projection area on the second radiating layer and it is a square with a side length of 2.1 to 2.5 mm.

7. The antenna unit of claim 1, wherein the second radiating layer is a projection area on the second dielectric layer and the projection area is a square with a side length of 2.5 to 2.8 mm.

8. The antenna unit of claim 1, wherein the ground layer is a projection area on the second dielectric layer and the projection area is a square with a side length of 4 to 5 mm.

9. The antenna unit of claim 1, wherein either the first dielectric layer has a thickness of 0.3 to 0.4 mm; or, the second dielectric layer has a thickness of 0.2 to 0.3 mm; or, the first dielectric layer has a thickness of 0.3 to 0.4 mm and the second dielectric layer has a thickness of 0.2 to 0.3 mm.

10. The antenna unit of claim 1, wherein the first feeder line comprises:

a first inner feeder line;

a first insulated wire; and a first outer feeder line is coaxially arranged from inside to outside, the first feeder line intersects from the ground layer, the first outer feeder line and the first insulated wire are cut off by the second radiating layer, the first outer feeder line is electrically coupled to the second radiating layer, the first inner feeder line is cut off by the first dielectric layer, and the first inner feeder line is electrically coupled to the first radiating layer.

11. The antenna unit of claim 1, wherein the second feeder line comprises:

a second inner feeder line;

a second insulated wire; and a second outer feeder line coaxially arranged from inside to outside, wherein the second feeder line intersects from the ground layer, the second outer feeder line and the second insulated wire are cut off by the ground layer, the second outer feeder line is electrically coupled to the ground layer, the second inner feeder line is cut off by the second dielectric layer, and the second inner feeder line is electrically coupled to the second radiating layer.

12. The antenna unit of claim 1, wherein an operating frequency of the first band comprises 40.5 to 43.5 GHz; and an operating frequency of the second band comprises 26.5 to 29.5 GHz.

13. An array antenna, comprising at least two antenna units, the two antenna units comprising:

a first microstrip antenna, comprising a first radiating layer coupled to a first dielectric layer wherein the first microstrip antenna operates at a first band;

a second microstrip antenna, comprising a second radiating layer, a second dielectric layer and a ground layer, sequentially coupled, wherein the second radiating layer is coupled to a side of the first dielectric layer facing away from the first radiating layer, and wherein the second microstrip antenna operates at a second band at frequencies lower than those of the first band;

a first feeder line, electrically coupled to the first radiating layer and the second radiating layer; and a second feeder line, electrically coupled to the second radiating layer and the ground layer;

wherein a distance between centers of two adjacent antenna units is 0.5 to 0.7 times an operating wavelength of the antenna unit;

wherein the first radiating layer is a first projection area on the first dielectric layer, the second radiating layer is a second projection area on the second dielectric layer, and the ground layer is a third projection area on the second dielectric layer, wherein the first, second, and third projection areas are squared and the center of the projection areas overlap;

wherein the first feeder line intersects the first microstrip antenna and a distance between an axis of the first feeder line and the center of the projection areas is 0.3 to 0.4 mm; wherein the second feeder line intersects the second microstrip antenna, and a distance between an axis of the second feeder line and the center of the projection areas is 0.45 to 0.55 mm.

14. The array antenna of claim 13, wherein the first radiating layer is a first projection area on the first dielectric layer, wherein the second radiating layer is a second projection area on the second dielectric layer, wherein the ground layer is a third projection area on the second dielectric layer, wherein at least two of the projection areas are reduced sequentially.

15. The array antenna of claim 13, further comprising at least one of:

the first radiating layer is a first projection area on the first dielectric layer that is a square with a side length of 1.5 to 2 mm;

the second radiating layer is a second projection area on the second dielectric layer that is a square with a side length of 2.5 to 2.8 mm;

the ground layer is a third projection area on the second dielectric layer that is a square with a side length of 4 to 5 mm; or the first dielectric layer is a fourth projection area on the second radiating layer that is a square with a side length of 2.1 to 2.5 mm.

16. The array antenna of claim 13, wherein either:

the first dielectric layer has a thickness of 0.3 to 0.4 mm;

the second dielectric layer has a thickness of 0.2 to 0.3 mm; or the first dielectric layer has a thickness of 0.3 to 0.4 mm and the second dielectric layer has a thickness of 0.2 to 0.3 mm.

17. An electronic device, comprising an array antenna including at least two antenna units, the antenna unit comprising:

a first microstrip antenna, comprising a first radiating layer coupled to a first dielectric layer wherein the first microstrip antenna operates at a first band;

a second microstrip antenna, comprising a second radiating layer, a second dielectric layer and a ground layer, sequentially coupled, wherein the second radiating layer is coupled to a side of the first dielectric layer facing away from the first radiating layer, and wherein the second microstrip antenna operates at a second band at frequencies lower than those of the first band;

a first feeder line, electrically coupled to the first radiating layer and the second radiating layer; and a second feeder line, electrically coupled to the second radiating layer and the ground layer;

wherein a distance between centers of two adjacent antenna units of the array antenna is 0.5 to 0.7 times an operating wavelength of the antenna unit;

wherein the first radiating layer is a first projection area on the first dielectric layer, the second radiating layer is a second projection area on the second dielectric layer, and the ground layer is a third projection area on the second dielectric layer, wherein the first, second, and third projection areas are squared and the center of the projection areas overlap;

wherein the first feeder line intersects the first microstrip antenna and a distance between an axis of the first feeder line and the center of the projection areas is 0.3 to 0.4 mm; wherein the second feeder line intersects the second microstrip antenna, and a distance between an axis of the second feeder line and the center of the projection areas is 0.45 to 0.55 mm.

18. The electronic device of claim 17, wherein the first radiating layer is a first projection area on the first dielectric layer, wherein the second radiating layer is a second projection area on the second dielectric layer, wherein the ground layer is a third projection area on the second dielectric layer, wherein at least two of the projection areas are reduced sequentially.

19. The electronic device of claim 17, further comprising at least one of:

the first radiating layer is a first projection area on the first dielectric layer that is a square with a side length of 1.5 to 2 mm;

the second radiating layer is a second projection area on the second dielectric layer that is a square with a side length of 2.5 to 2.8 mm;

the ground layer is a third projection area on the second dielectric layer that is a square with a side length of 4 to 5 mm; or the first dielectric layer is a fourth projection area on the second radiating layer that is a square with a side length of 2.1 to 2.5 mm.

* * * * *